US009085924B2

(12) United States Patent
Tidwell

(10) Patent No.: US 9,085,924 B2
(45) Date of Patent: Jul. 21, 2015

(54) LIFT ADJUST SLIDING DOOR ROLLER

(71) Applicant: Milgard Manufacturing Incorporated, Taylor, MI (US)

(72) Inventor: Drannan Tidwell, Federal Way, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 13/725,596

(22) Filed: Dec. 21, 2012

(65) Prior Publication Data

US 2014/0150209 A1 Jun. 5, 2014

Related U.S. Application Data

(60) Provisional application No. 61/733,418, filed on Dec. 4, 2012.

(51) Int. Cl.
*E05D 15/06* (2006.01)

(52) U.S. Cl.
CPC ..... *E05D 15/0669* (2013.01); *E05Y 2201/638* (2013.01); *E05Y 2900/132* (2013.01); *Y10T 16/3819* (2015.01); *Y10T 16/3834* (2015.01)

(58) Field of Classification Search
CPC ..... E05D 15/0626; E05D 15/063; E05D 15/0634; E05D 15/066; E05D 15/0665; E05D 15/0669; Y10T 16/381; Y10T 16/3816; Y10T 16/3819; Y10T 16/3834; Y10T 16/3837; Y10T 16/384; Y10T 16/364; Y10T 16/193; Y10T 16/1937; Y10T 16/1943; Y10T 16/212; E05Y 2201/638; E05Y 2900/132; B60B 33/04
USPC ..... 16/97, 99, 100, 105–107, 91, 32–34, 16/44; 49/425, 410, 420; 160/105; 280/43.21
See application file for complete search history.

(56) References Cited

U.S. PATENT DOCUMENTS

| | | | | |
|---|---|---|---|---|
| 2,940,113 | A * | 6/1960 | Riser | 16/105 |
| 3,237,238 | A * | 3/1966 | Anderson | 16/105 |
| 3,428,999 | A * | 2/1969 | Benson, Jr. | 16/103 |
| 4,134,178 | A * | 1/1979 | Stevens | 16/100 |
| 4,805,262 | A * | 2/1989 | Marshik | 16/105 |
| 4,850,078 | A * | 7/1989 | Libby et al. | 16/100 |
| 5,161,330 | A | 11/1992 | Auriemma | |
| 5,546,706 | A | 8/1996 | Coupet | |
| 5,845,363 | A * | 12/1998 | Brempell et al. | 16/105 |
| 6,185,784 | B1 | 2/2001 | Gamperle | |
| 7,770,329 | B2 * | 8/2010 | Hutnik et al. | 49/425 |

(Continued)

FOREIGN PATENT DOCUMENTS

| | | |
|---|---|---|
| EP | 1120522 A | 8/2001 |
| JP | 403208978 | 9/1991 |
| JP | 2006207196 A | 8/2006 |

*Primary Examiner* — William Miller
(74) *Attorney, Agent, or Firm* — Rathe Lindenbaum LLP

(57) ABSTRACT

A sliding door roller system comprising a wheel housing, two roller wheels rotatably coupled to the wheel housing, an upper base, a second housing configured to be secured to a door and a ratchet mechanism coupled to the first housing and second housing, discretely stepping the second housing away from the first housing in a plurality of positions.

18 Claims, 11 Drawing Sheets

(56) References Cited

U.S. PATENT DOCUMENTS

| | | | | |
|---|---|---|---|---|
| 7,849,560 | B2 * | 12/2010 | Kelley | 16/105 |
| 8,240,089 | B2 * | 8/2012 | Lambertini | 49/425 |
| 2003/0127827 | A1 | 7/2003 | Hulsey et al. | |
| 2005/0000164 | A1 | 1/2005 | Jacobs | |
| 2005/0011041 | A1 * | 1/2005 | Ness | 16/105 |
| 2007/0017065 | A1 | 1/2007 | Hutnik et al. | |
| 2009/0044468 | A1 | 2/2009 | Scapin | |
| 2010/0269291 | A1 | 10/2010 | Haab et al. | |

* cited by examiner

LIFT ADJUST SLIDING DOOR ROLLER

CROSS-REFERENCE TO RELATED PATENT APPLICATIONS

This application claims the benefit of U.S. Provisional Application No. 61/733,418 filed Dec. 4, 2012 entitled LIFT ADJUST SLIDING DOOR ROLLER.

BACKGROUND

The present invention relates generally to the field of sliding door and/or window assemblies and more particularly, to a sliding door with a roller carriage. Sliding doors are used to provide ingress and egress from a building structure. Roller carriages allow the sliding door to slide on a track in the sill. Roller carriages may include an adjustment mechanism to adjust the height of the sliding door relative to the track in the sill.

SUMMARY OF THE INVENTION

A sliding door roller system comprising a wheel housing, two roller wheels rotatably coupled to the wheel housing, an upper base, a second housing configured to be secured to a door and a ratchet mechanism coupled to the first housing and second housing, discretely stepping the second housing away from the first housing in a plurality of positions.

A method for aligning a door using a sliding door roller system including placing a door on a horizontal platform of a sliding door roller system, lifting the door away from the sliding door roller system, allowing the sliding door roller system to raise the horizontal platform, replacing the door on the horizontal platform, comparing the door's new position with a benchmark and redoing the process if the new position does not meet the benchmark or stopping if the new position meets the benchmark.

DETAILED DESCRIPTION OF THE EXAMPLE EMBODIMENTS

Figure 1:
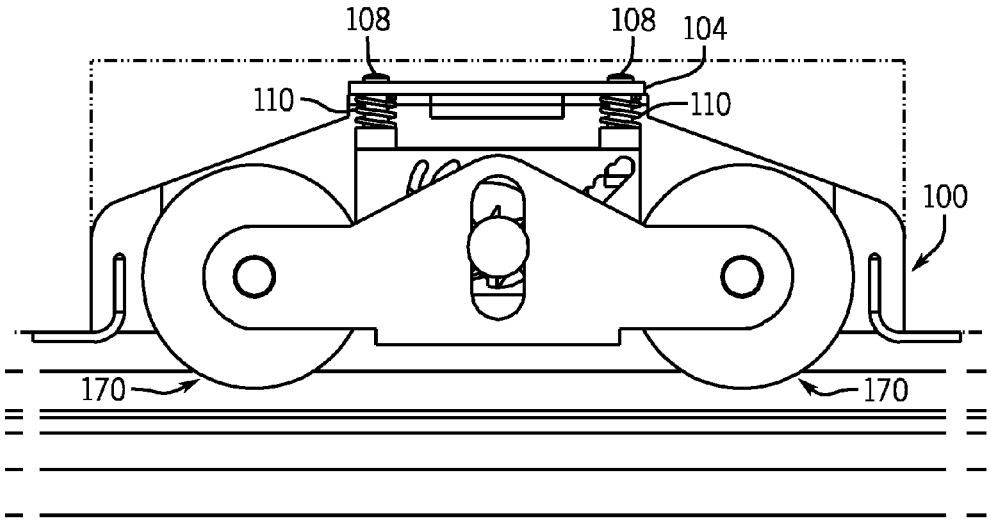
FIG. 1 is a first embodiment view of a sliding door assembly in the initial configuration.
Figure 2:
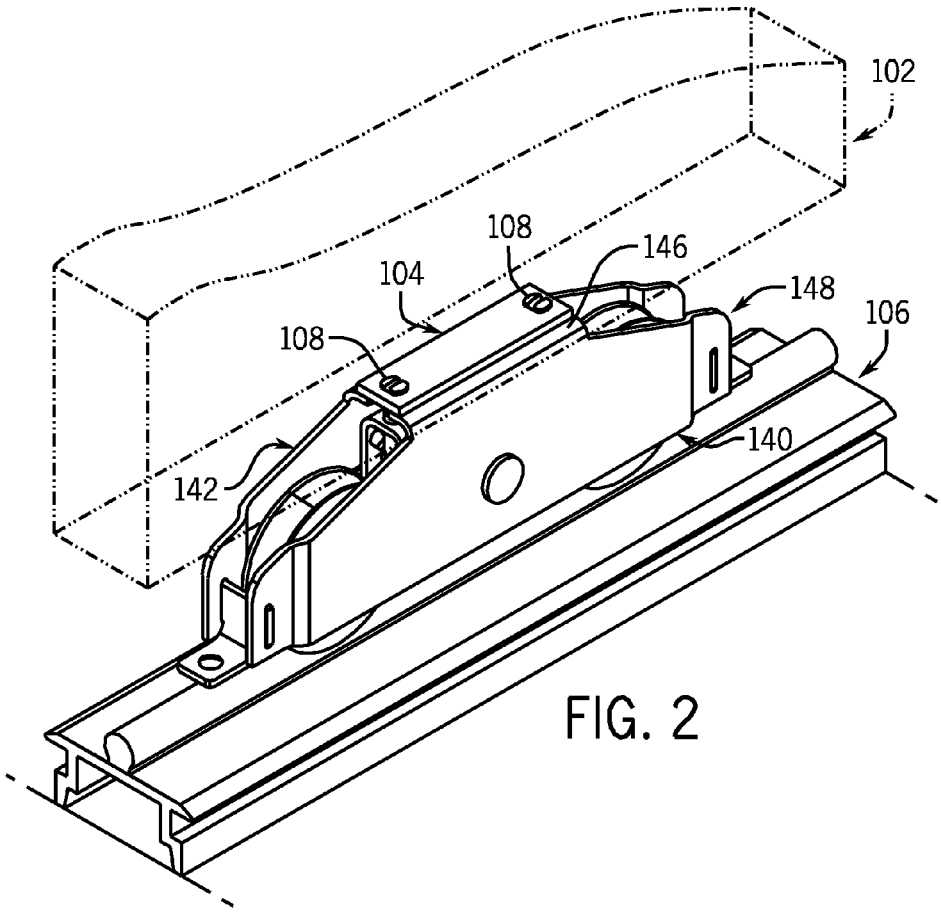
FIG. 2 is a first embodiment view of the sliding door assembly on a door track.

Referring to FIGS. 1 and 2 a sliding door roller system supports a door 102 along a wheel track 106. Sliding door roller system 100 includes a horizontal platform 104 supported by two posts 108 surrounded by a post spring 110. The posts 108 are supported by a ratchet assembly 112.

Figure 3:
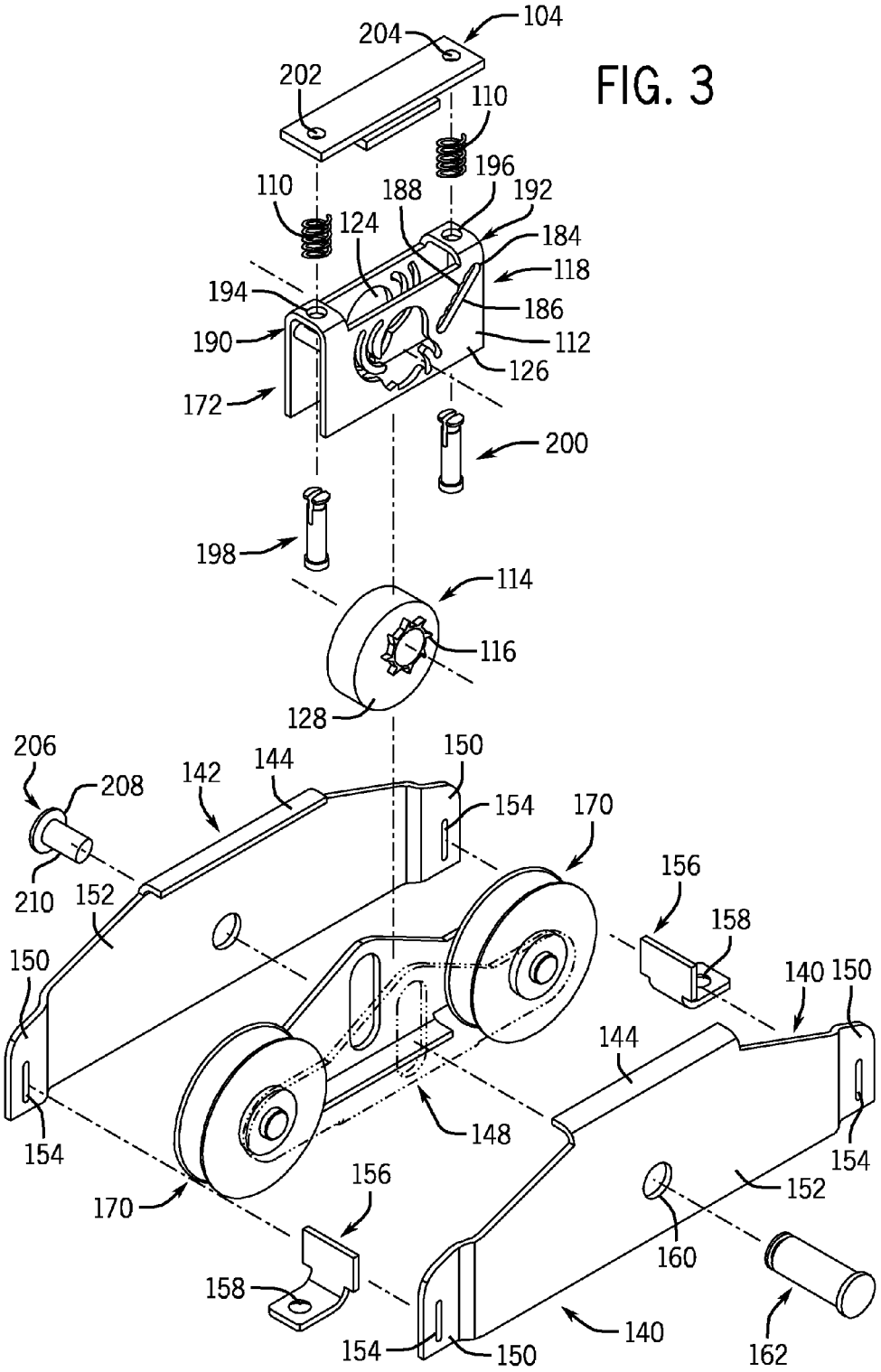
FIG. 3 is a first embodiment exploded view of the sliding door assembly.

Referring to FIG. 3, ratchet assembly 112 contains a gear wheel 114 with two side-mounted gears 116. Each side-mounted gear 116 has teeth 118. Two pawls 120, 122 and a large circular cavity 124 are formed on the two ratchet assembly sides 126, 128 of the ratchet assembly 112. Pawl 120 is located in the upper half of the ratchet assembly side 126. Pawl 122 is located in the lower half of the ratchet assembly side 126. In this embodiment, pawl 120 is longer than pawl 122. Pawl 120 is formed by two parallel aperture arcs 130, 132. Pawl 122 is formed by two different parallel aperture arcs 134, 136. The two pawls 120, 122 are needed to hold the gear 116 in place when not rotating. The material for the ratchet assembly sides 126, 128 which contain pawls 120, 122 needs be of a type that allows the two pawls 120, 122 to be slightly flexible and be resistant to material fatigue.

Figure 4:
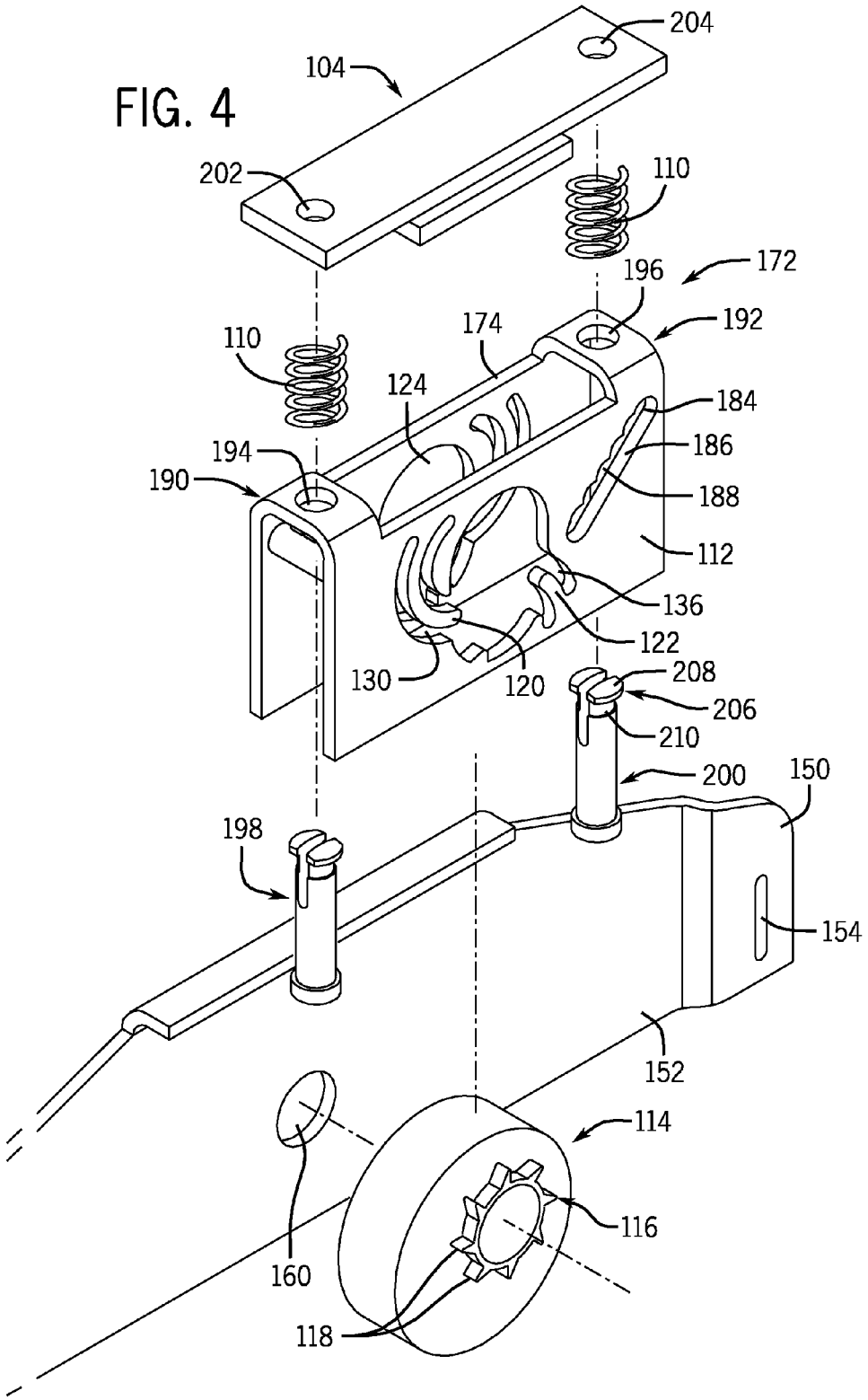
FIG. 4 is a close up exploded view of the first embodiment of the wheel ratchet housing.

In terms of assembly, FIGS. 3 and 4 show an exploded view of the outer housing that is made up of two mirror image shells 140, 142. Each shell 140, 142 as an upper lip 144 that bend approximately 90° towards each other. When eventually combined, these two lips 144 form a roof 146 that has the inner workings or wheel assembly housing 148 of the ratchet assembly 112 underneath the roof 146. Each shell 140 has a wing 150 on each side (for a total of four wings over two shells 140). Each wing 150 bends slightly inward and then bend slightly outward again, such that the exterior of each wine 150 is parallel to the main surface 152 of each shell 140. On each wing 150, there is a rectangular hole 154. When assembled, these rectangular holes 154 support two right angle tabs 156. Each right angle tab 156 has a circular hole 158. Each hole 158 is parallel to the wheel track 106 and is used for additional mounting of the door 102.

The middle of each shell 140 has an aperture 160 in the middle of the shell 140. Both apertures 154 support a large pin 162 and other components which will be described below.

The two shells 140, when put together, form the wheel assembly housing 148. Within the wheel assembly housing 148 are two wheels 170. The wheel assembly housing 148 has an inner housing or adjustment plate 172. The inner housing 172 is U-shaped. The inner housing 172 has two ratchet assembly sides 126, 128. in the middle of each ratchet assembly sides 126, 128, there is a relatively large circular cavity 124. Tangent to each circular cavity 124 is a pawl 120 as described earlier.

Unique to the front ratchet assembly side 126 there is an oval-like hole 184 to the right of the large circular cavity 124 as viewed from FIGS. 3 and 4. The oval like aperture 184 has a smooth surface 186 and a multiple grooves side 188.

The top of the inner housing 172 comprises a left C-shaped piece 190 and a right C-shaped piece 192. The left C-shaped piece 190 has a small circular hole 194. The right C-shaped piece 192 also has a small circular hole 196. Both small circular holes 194, 196 are symmetrically placed within each C-shaped piece 190, 192. The small circular hole 194 of the left C-shaped piece 190 supports a left post 198. The small circular hole 196 of the right C-shaped piece 192 supports a right post 200. Each post 198, 200 supports and secures the horizontal platform 104.

The horizontal platform 104 has a left hole 202 and a right hole 204 to support and hold each post 198, 200 respectively.

The right post 200 has a step pin 206 attached to the bottom of post 200. The step pin 206 is flat mushroom shaped in this embodiment. The mushroom cap side 208 of the step pin 206 is the portion that attaches to the bottom of the post 200. The mushroom stems side 210 of the step pin 206 is the portion that goes into and travels through the oval like aperture 184. The step pin 206 design creates the incremental and decremental steps as the door 102 is lifted and released using each groove 184.

Figure 5:
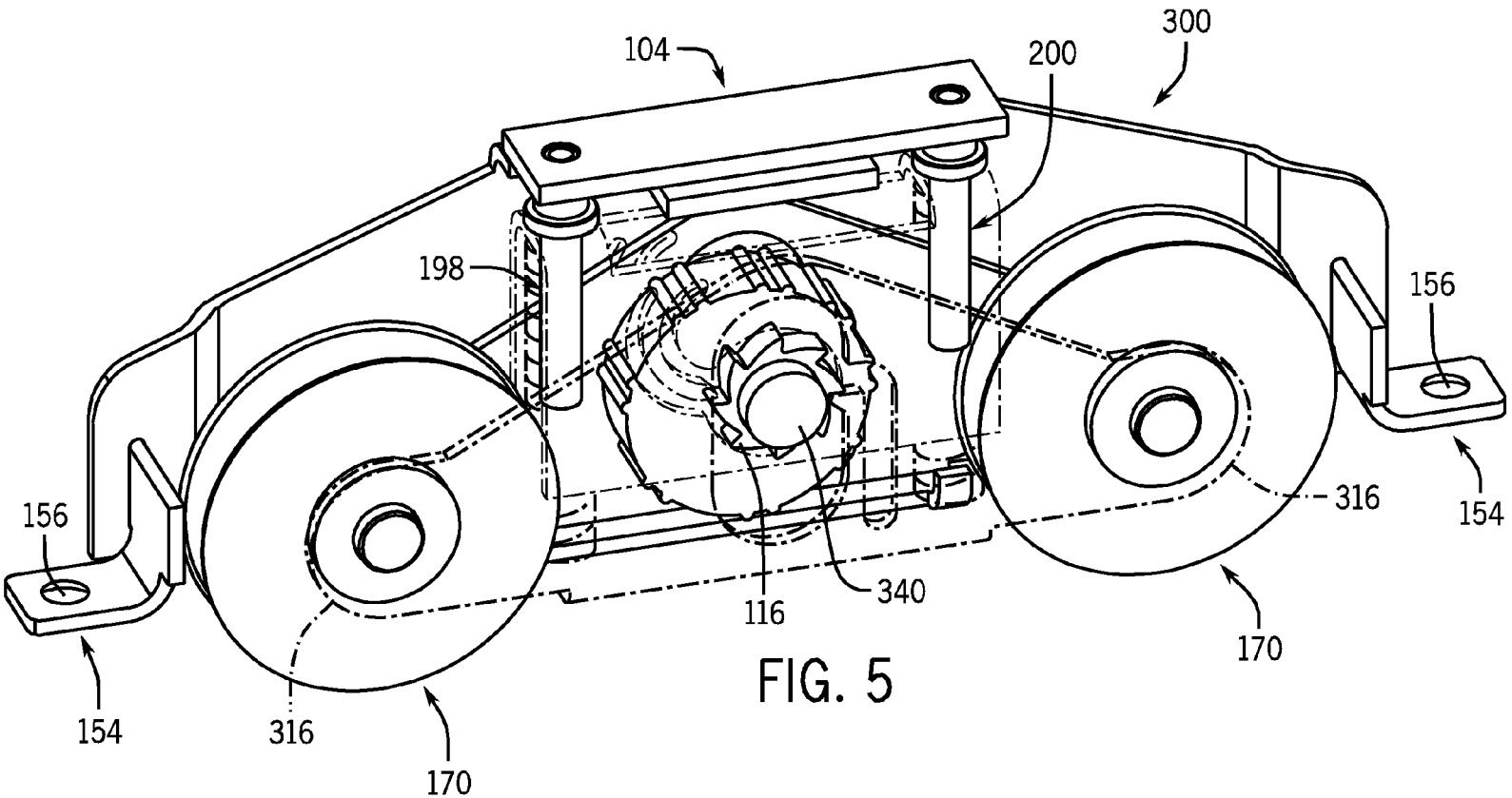
FIG. 5 is a second embodiment side view of an assembled sliding door assembly.
Figure 6:
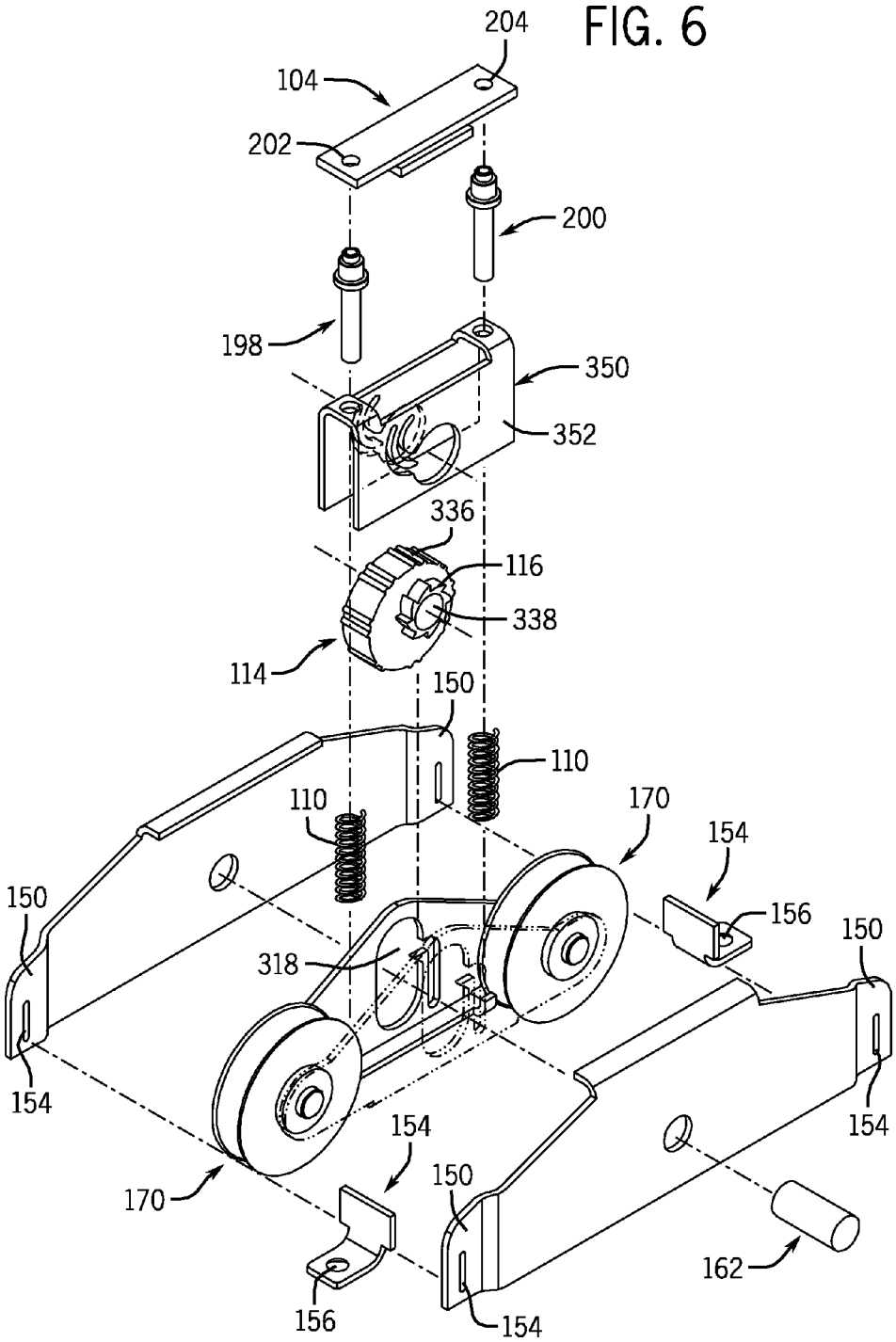
FIG. 6 is a second embodiment exploded view of the sliding door assembly.

Referring to FIG. 5 and FIG. 6 a second embodiment has a housing 148 similar to the first embodiment, but as described below has a number of different components.

FIG. 6 show a close-up exploded view of the wheel assembly 300 that includes two wheels 170. Each wheel comprises a thick tire portion 302, a washer 304, and axle aperture 306 and a wheel axle 308. Holding the two wheels 170 in place are two triangular plates 312. The two triangular plates 312 are obtuse triangles with rounded corners. The two rounded corners at the two ends of the hypotenuse 314 are expanded circle ends 316. Circle ends 316 form approximately one-half of a circle. The remaining one-half of the circle ends 316 blend in within the triangular plates 312.

Within the center of the triangular plates 312 is a large circular aperture 318. Each large circular aperture 318 is in proximity to the obtuse angle 320 of the triangular plates 312 as well as the hypotenuse 314 of the triangular plates 312.

Adjacent to each large circular aperture 318 is an L-shaped aperture 322. The top of the stem 324 of each L-shaped aperture 322 are in proximity to the hypotenuse 314. The unconnected end 326 of the base of the L-shaped aperture 322 integrates with each large circular aperture 318.

The combination of the large circular aperture 318 and the L-shaped aperture 322 form a vertical pawl 328. Each vertical pawl 328 has long stem 329. At the top of each stem 329 is a triangular extension 332 that points towards the center of each large circular aperture 318. Based on this design, the vertical pawl 328 is slightly flexible within the plane of the triangular plates 312.

Figure 8:
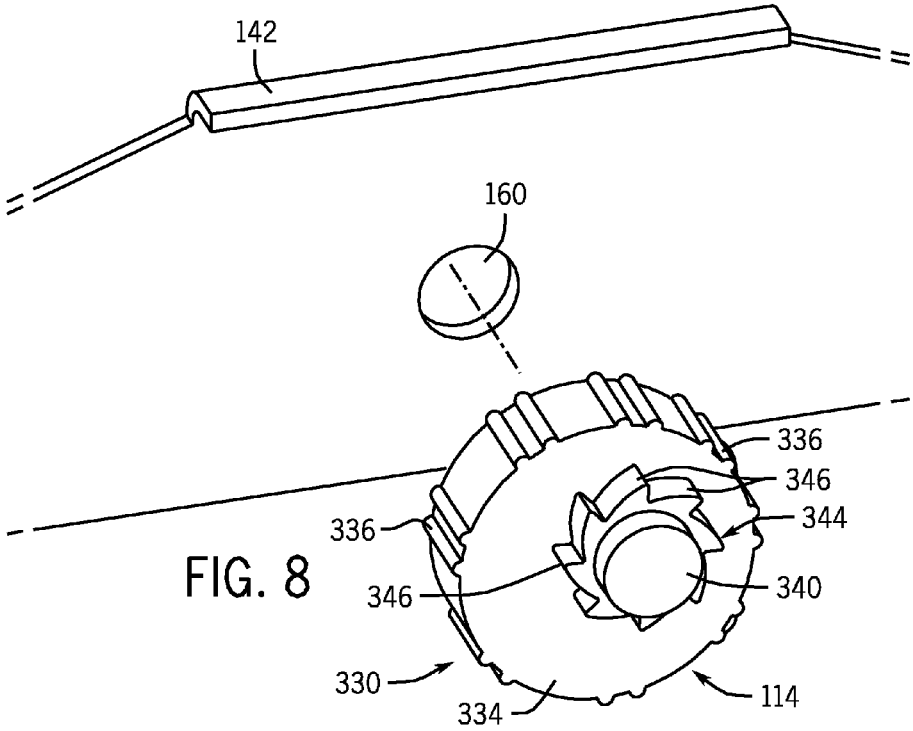
FIG. 8 is a second embodiment exploded side view of the ratchet wheel house assembly.
Figure 7:
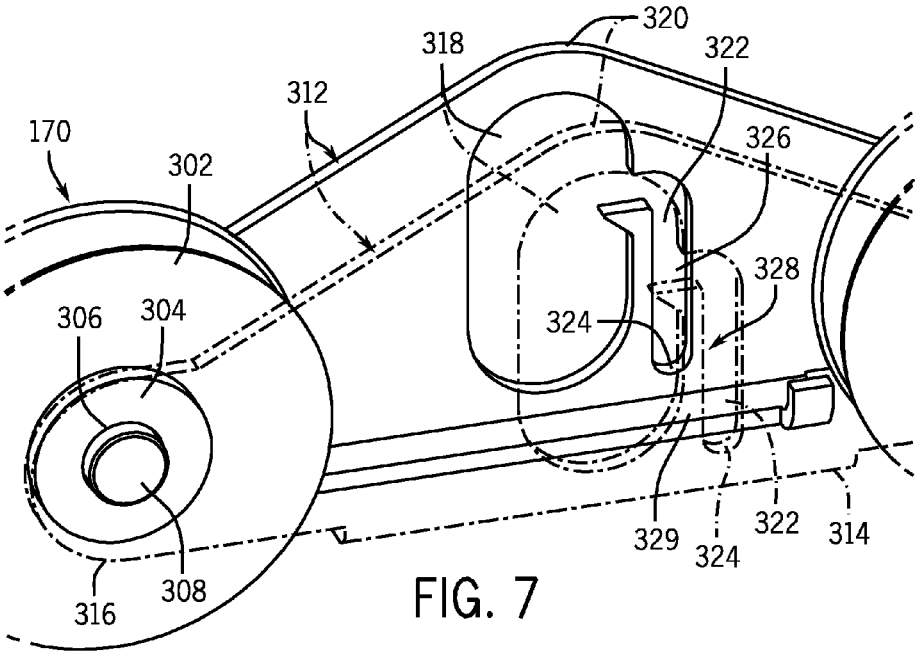
FIG. 7 is a close view of the second embodiment of the sliding door assembly.

As shown in FIG. 8, the wheel ratchet 330 as in the previous embodiment rotates within the center portion of the triangular plates 312. The wheel ratchet 330 comprises a base tire portion 334. The outer circular portion 134 of the base tire portion 0334 has half cylinder convex treads 336. The center of the wheel ratchet 330 has an aperture 338. The wheel ratchet aperture 338 designed to support a wheel ratchet axis 340. Mounted on each flat side 342 of the wheel ratchet 330 is a gear 344. Both the wheel ratchet 330 and the gear 311 form aperture 338. Each gearwheel 344 comprises gear teeth 346.

Enveloping the wheel ratchet 330 is the wheel ratchet housing 350. The wheel ratchet housing is U-shaped as in the previous embodiment. The side ends 352 of the U-shaped wheel ratchet housing 350 each have a large circular aperture 354 on each side of each flat surface 352. The diameter of each large circular aperture 354 is designed to be slightly larger than the diameter of the wheel ratchet gear 344. Each side end 352 extending away from the wheel ratchet 330 have an inner arc aperture 356 and an outer arc aperture 358 The outer arc apertures 358 is parallel to the respective inner C-shaped aperture 356. All arcs 356, 358 would bend upward towards platform 104. The result of the arc apertures 356, 356 creates two C-shaped pawls 360. Each exposed end 362 of each C-shaped pawl 360 is formed into a triangle 364. Each triangle 364 is designed to embed between the curved teeth 346 of the wheel ratchet gear 344.

A different embodiment (not shown), a second set of pawls may be added to the side ends 352 near the bottom portion, closer to post 368. Each side end 352 extending away from the wheel ratchet 330 would have two inner arc apertures 356 and two outer arc apertures 358 (a total of four inner arc apertures 356 and four outer arc apertures 356 for both side ends 352). In other words, two pawls 360 would be near post 366 and two additional pawls would he near post 368. All outer arc apertures 358 are parallel to a respective inner C-shaped aperture 356. All arcs 356, 358 would bend upward towards platform 104. The result of the arc apertures 356, 358 creates four C-shaped pawls 360, two pawls per side end 352. This configuration would provide more stability for the gearwheel 344.

Figure 9:
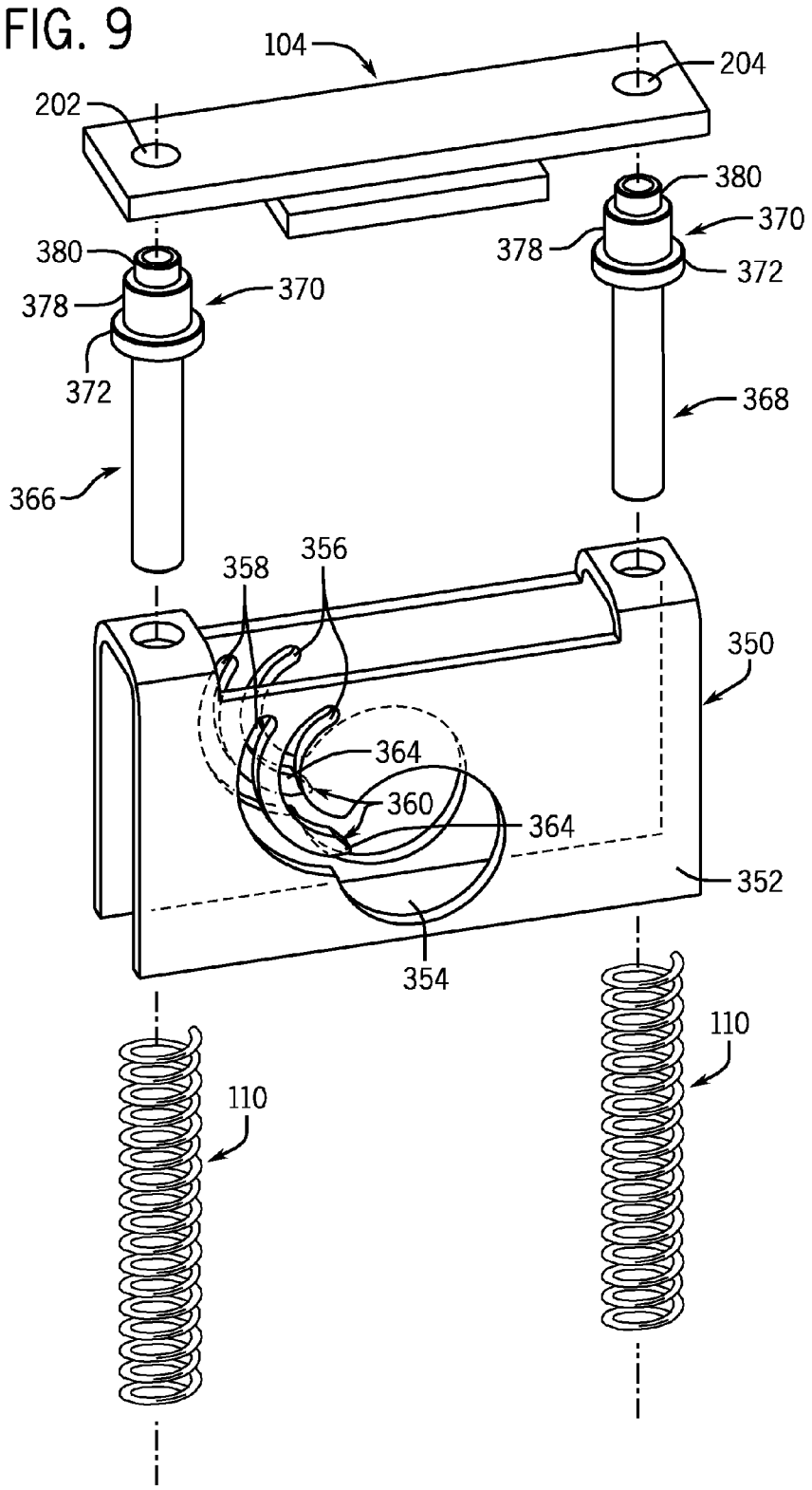
FIG. 9 is a second embodiment exploded view a close-up of the platform assembly.

FIG. 9 shows with respect to the base of the U-shaped portion of the wheel ratchet housing 350, the majority of the base is missing. Only at the side ends 352 of the wheel ratchet housing 350 are two C-shaped, connectors 362 that are seamlessly molded as part of the entire wheel ratchet housing 350. On the outer surface of the long side of the letter 'C' is a circular aperture 364 (one for each connector 362).

FIG. 9 shows each circular aperture 364 is designed to accept posts 366, 368. Posts 366, 368 are similar in function and shape to posts 198, 200. The main difference between posts 366, 368 and posts 198, 200 from the first embodiment is the top end 370. Each top end 370 includes three layers. The base layer 372 of the top end 370 provides support for a spring 110. Each spring 110 is held in place by mini-hooks 376 that are embedded in the base layer 372. The diameter of each spring 110 is slightly larger than the diameter of the middle layer 378 of the top end 370. Thereby, each. spring 110 rests on top of the base layer 372 and envelops the middle layer 378.

This embodiment uses the same horizontal platform 104 as in the previous embodiment. Both top layers 380 of each top end 370 are designed to penetrate apertures 202, 204. Thus, the top portion of each spring 110 presses against the bottom of the horizontal platform 104.

Figure 10:
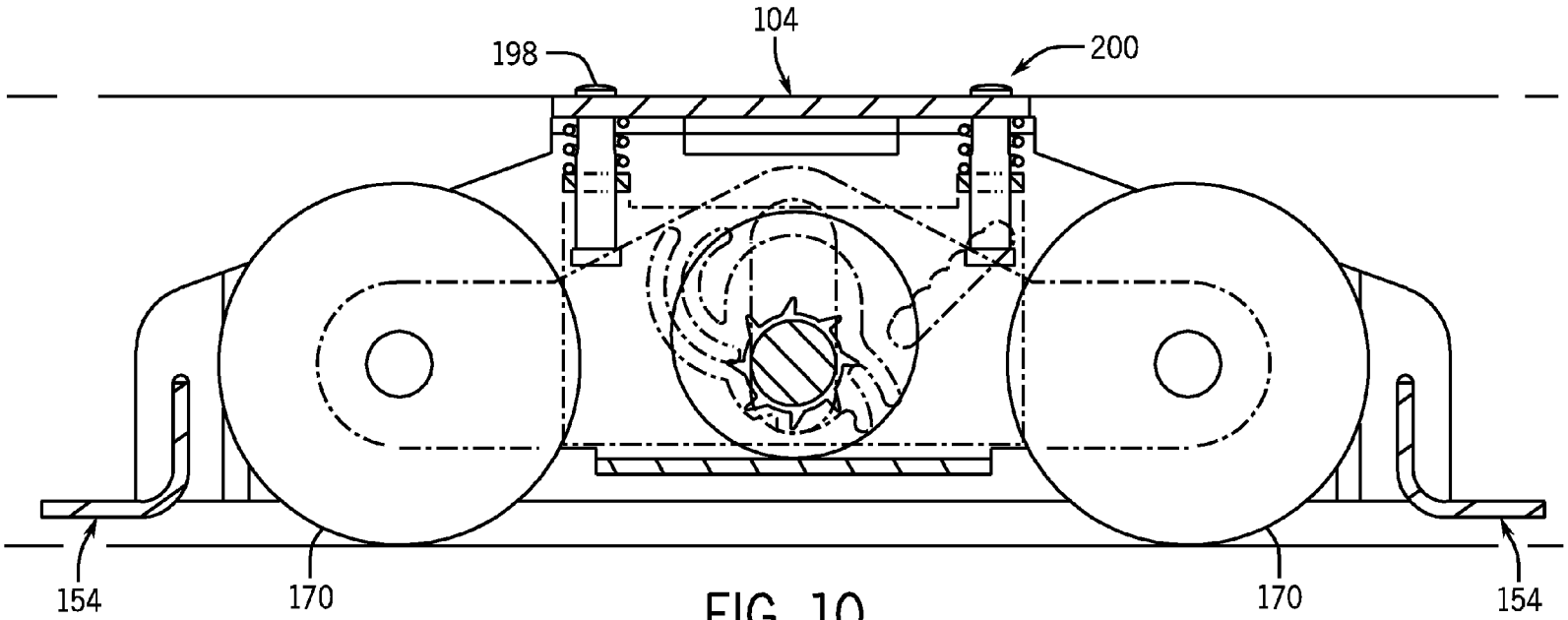
FIG. 10 is a first embodiment assembled view of a platform in a lowered position.
Figure 12:
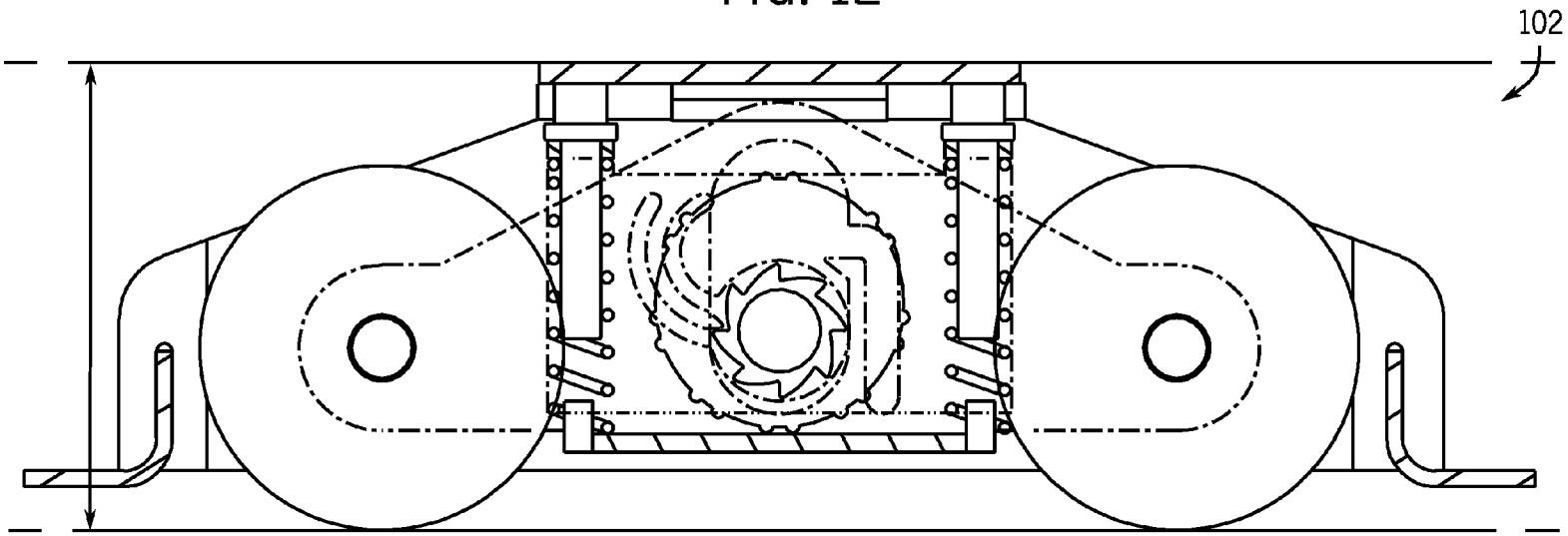
FIG. 12 is a second embodiment assembled view of a platform in a lowered position.

FIGS. 10 & 12 show the lift 100, 300 in a fully lowered state. As a starting point, an operator has a door 102 on top of the platform 104. The operator simply lifts the door 102 and puts the door 102 back on top of the platform 104. As the door 102 is lifted, the off-center cam 114, 342 rotates. The posts 108 and springs 110 push the platform 104 up, away from the wheel track 106. The gear teeth 118, 346 of the gearwheel 116, 344 causes all of the pawls 120, 122, 328, 360 to bend away from the gearwheel 116, 344 as the gearwheel 116, 344 rotates. The pawls 120, 122, 328, 360 snap back into the original non-tension state when a gearwheel tooth 118, 346 rotates past all pawls 120, 122, 328, 360. These steps or process define a door height adjustment cycle. During the first half of the rotation of the off-center cams 114, 342, the platform 104 is moving upward, away from the wheel track 106.

Figure 11:
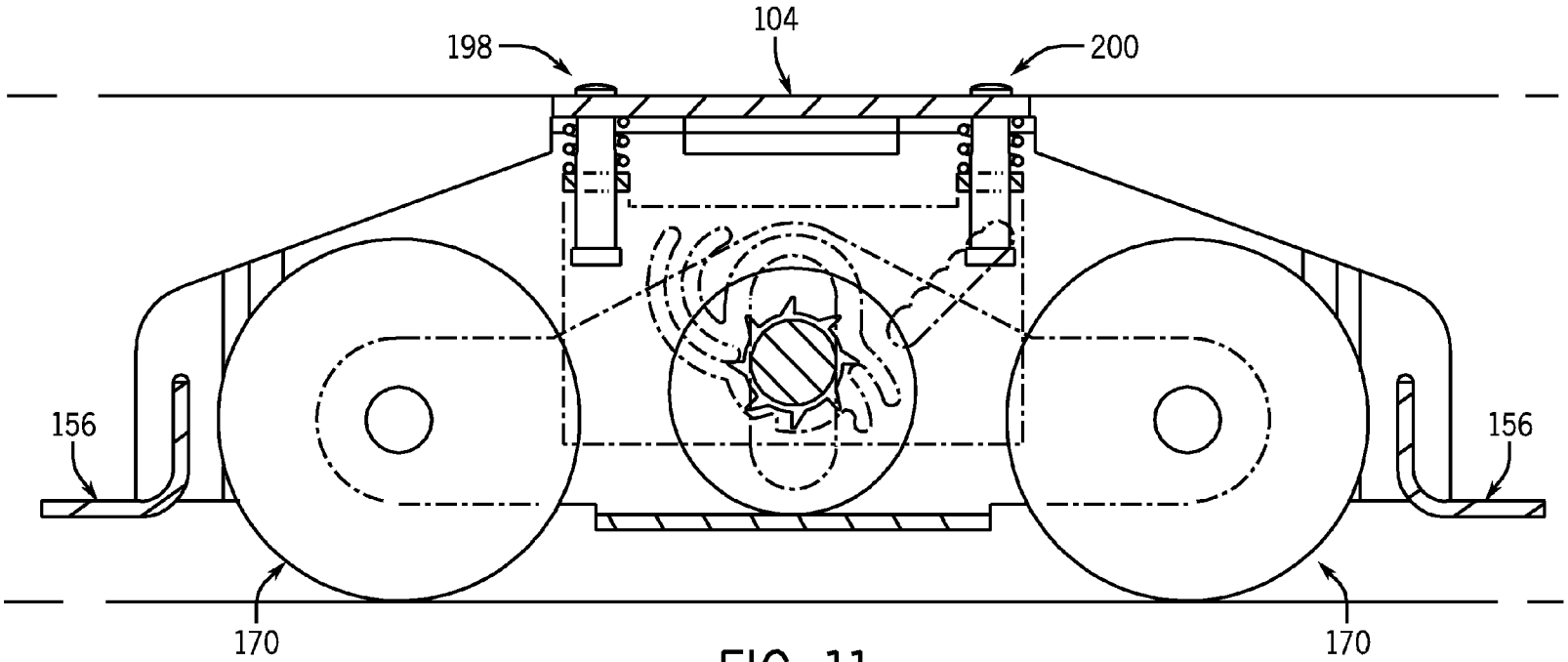
FIG. 11 is a first embodiment assembled view of a platform in a raised position.
Figure 13:
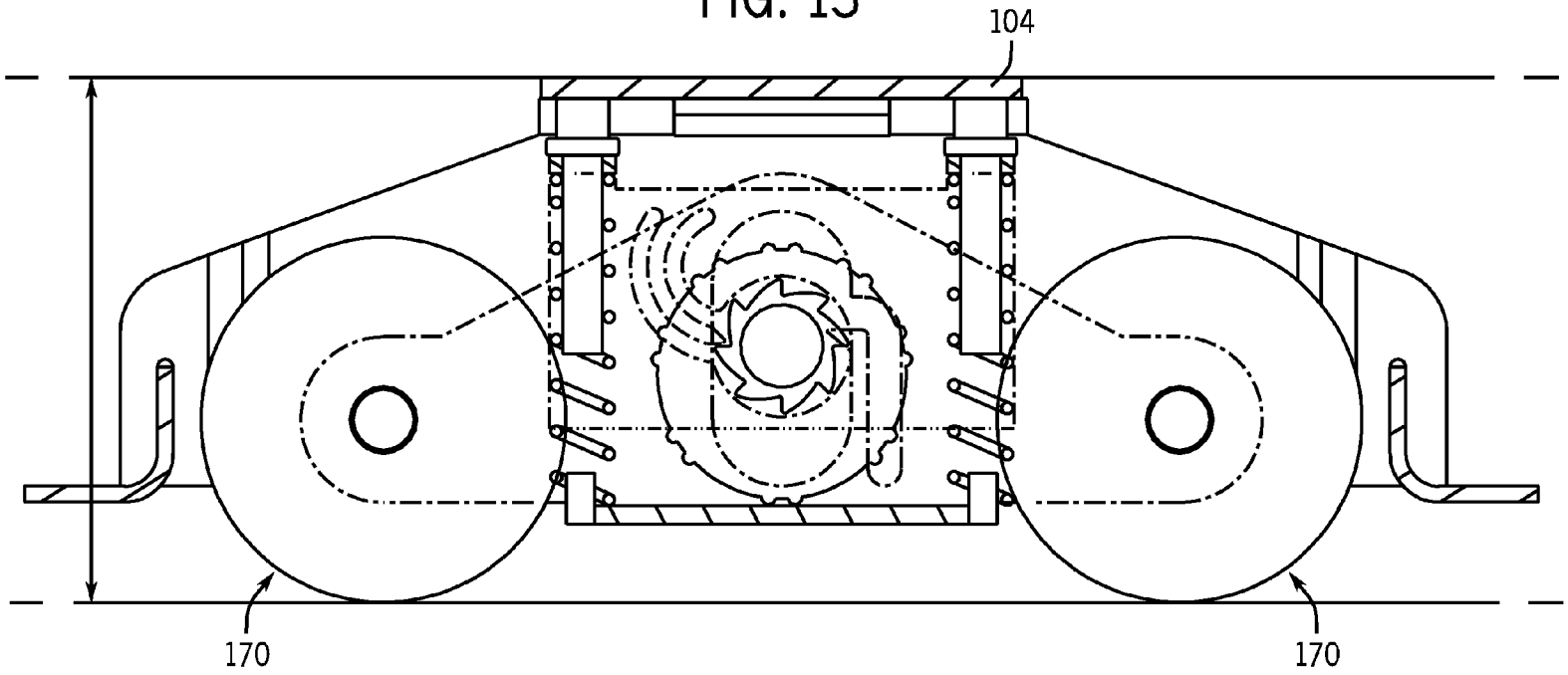
FIG. 13 is a second embodiment assembled view of a platform in a raised position.

At this point, the operator determines if the door 102 is in the proper position. If the door 102 is still too low, the door height adjustment cycle is repeated until the door 102 is at the proper height. FIGS. 11 & 13 show the platform 104 at a fully heightened state. If it is determined that the door 102 is too high, the door height adjustment cycle is repeated until the off-center cam 114, 342 is rotated 180°. At this point, as each door height adjustment cycle is repeated, the platform 104 will begin to lower. The platform 104 will continue to lower with each door height adjustment cycle for the second half of the 180° rotation of the off-center cam 114, 342. At the end of the second half of the 180° rotation of the off-center cam 114, 342, the platform 104 will begin to rise again using the first half of the 180° portion of the off-center cam 114, 342 as described earlier. Thus, a door 102 can be raised or lowered using a sufficient number of described door height adjustment cycles.

It is important to note that the construction and arrangement of the latch mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating. conditions and arrangement of the exemplary embodiments without departing from the scope of the present inventions as expressed in the appended claims.

What is claimed is:

1. A sliding door roller system comprising:

a wheel housing;

two roller wheels rotatably coupled to the wheel housing;

an upper base;

a second housing configured to be secured to a door; and a ratchet mechanism coupled to the wheel housing and second housing, discretely stepping the second housing away from the wheel hosing in a plurality of positions, wherein the ratchet mechanism comprises a ratchet wheel with at least one gear wheel mounted thereto.

2. The sliding door roller system of claim 1, further including at least one spring between the ratchet mechanism and the door activating the ratchet mechanism upon lifting door in a direction away from the wheel housing.

3. The sliding door roller system of claim 1, wherein the ratchet wheel is mounted off-center.

4. The sliding door roller system of claim 1 wherein the ratchet mechanism comprises a ratchet mechanism housing.

5. The sliding door roller system of claim 4, wherein the ratchet mechanism housing is contains at least one tooth.

6. The sliding door roller system of claim 1, wherein the ratchet mechanism is located above the two roller wheels.

7. The sliding door roller system of claim 1, wherein the wheel housing comprises at least one tooth.

8. The sliding door roller system of claim 1, wherein the wheel housing comprises two plates.

9. A sliding door roller system comprising:

a wheel assembly comprising:

a first wheel axle, a second wheel axle, a first wheel housing plate, a second wheel housing plate, a first wheel, and a second wheel;

a ratchet housing movably located between the first wheel housing plate and the second wheel housing plate, the ratchet housing having at least one pawl;

a cam having a gear offset from a center of the cam, the gear having gear teeth operatively engaging the pawl;

a spring biased platform extending from the ratchet housing in a direction away from the first wheel and second wheel;

wherein, the cam is rotated relative to the wheel assembly moving the platform relative to the first wheel and second wheel.

10. The sliding door roller system of claim 9, wherein the ratchet housing includes grooves defining the ratchet housing pawl.

11. The sliding door roller system of claim 10, wherein the first wheel housing plate includes a wheel housing pawl.

12. The sliding door roller system of claim 11, wherein the ratchet housing includes an angled slot relative to the platform.

13. The sliding door roller system of claim 12, wherein a pin extends through the angled slot.

14. The sliding door roller system of claim 13, the second housing plate contains a long tooth and a short tooth and interface with the cam.

15. The sliding door roller system of claim 9, wherein the cam has an outer periphery with treads.

16. The sliding door roller system of claim 9, wherein at least one of the housing plates contains at least one tooth.

17. The sliding door roller system of claim 9, wherein the cam is mounted off-center.

18. The sliding door roller system of claim 17, wherein the cam raises and lowers the platform.

* * * * *